US006776021B2

(12) United States Patent
Scholey

(10) Patent No.: US 6,776,021 B2
(45) Date of Patent: Aug. 17, 2004

(54) HYDRAULIC DRIVE FOR USE IN CAN MANUFACTURE

(75) Inventor: Ian Scholey, Wakefield (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/368,590

(22) Filed: Feb. 20, 2003

(65) Prior Publication Data

US 2003/0121305 A1 Jul. 3, 2003

Related U.S. Application Data

(63) Continuation-in-part of application No. 10/276,420, filed as application No. PCT/GB01/02531 on Jun. 8, 2001.

(30) Foreign Application Priority Data

Jun. 19, 2000 (EP) ..... 00305162

(51) Int. Cl.[7] ..... B21D 24/14
(52) U.S. Cl. ..... 72/349; 72/453.18; 72/456
(58) Field of Search ..... 72/347, 349, 350, 72/453.18, 456; 100/269.18

(56) References Cited

U.S. PATENT DOCUMENTS

| | | | | | |
|---|---|---|---|---|---|
| 538,656 | A | * | 5/1895 | Butters | 72/345 |
| 1,429,421 | A | * | 9/1922 | Fritsch et al. | 72/453.18 |
| 3,745,804 | A | * | 7/1973 | Langewis et al. | 72/349 |
| 5,249,448 | A | * | 10/1993 | Fedor et al. | 72/349 |
| 5,775,160 | A | * | 7/1998 | Fleischer et al. | 72/349 |

* cited by examiner

*Primary Examiner*—Lowell A. Larson
(74) *Attorney, Agent, or Firm*—Diller, Ramik & Wight

(57) ABSTRACT

A drive for use in the manufacture of cans comprises a hydraulically powered guide pod to which a can bodymaker is attached. The guide pod slides along a guide rod which is fixed in the bodymaker. Forward and rear hydraulic chambers are defined between the pod and the guide rod by means of bushings and a seal. Passage of fluid through ports to and from the chambers causes the pod and bodymaker to move forwards and backwards. The length of the stroke can be set by the distance between the ports. A rotary valve is used to control the timing of the drive and control flow of hydraulic fluid, which is typically obtained from the bodymaker coolant supply.

14 Claims, 5 Drawing Sheets

HYDRAULIC DRIVE FOR USE IN CAN MANUFACTURE

CROSS-REFERENCE TO RELATED APPLICATION

This application is a continuation-in-part application of U.S. Ser. No. 10/276,420 filed on Nov. 15, 2002, which was a national phase filing of International Application No. PCT/GB01/02531 filed internationally on Jun. 8, 2001.

BACKGROUND OF THE APPLICATION

This invention relates to a hydraulic drive for a hold down assembly for use in the manufacture of cans. In particular, but not exclusively, it relates to a drive for long stroke press. In the can industry, these long stroke presses are generally referred to as "bodymakers" and are used to iron the side wall of a drawn metal cup to make a taller can.

The parent application, U.S. patent application Ser. No. 10/276,420, describes a drive for a hold down assembly, such as a blank holder, which holds a can blank against a redraw die.

Hold down mechanisms, such as redraw sleeves and blanking punches, are known. Typically, a lever is held against cam profiles on the crank. The lever drives a pair of push rods to drive a crosshead which, in turn, actuates a blank holder. This combination of push rods and cam actuation moves the blank holder towards a redraw die to bring the can blank, or cup, to the die. The blank holder presses the base of the cup against a flat face of the die while a punch pushes the cup into the die for redrawing.

This type of mechanism is heavy and the rotating mass on the crankshaft presents a severe load to the bodymaker main bearings. The parent application seeks to reduce problems associated with this loading.

SUMMARY OF THE INVENTION

The present invention seeks to adapt the hold down of the parent application for driving other press mechanisms, such as bodymakers, which require longer strokes, higher linear speeds, higher forces and increased flow rate than those of the hold down apparatus.

According to the present invention there is provided a hydraulic drive for a can bodymaker, the drive comprising a fixed guide rod; a guide pod surrounding the guide rod, the pod having rear and forward end faces which together define rear and forward hydraulic chambers, respectively, the chambers being separated by a seal; a first channel (A) for the passage of hydraulic fluid to and from the rear hydraulic chamber via a return stroke port; a second channel (B) for the passage of hydraulic fluid to and from the forward hydraulic chamber via a forward stroke port; whereby passage of fluid into the forward chamber drives the pod and bodymaker connected thereto to a forward position and passage of fluid into the rear chamber forces the pod and bodymaker to return to a back position.

By using a hydraulically powered drive for the bodymaker, the whole crankcase, including the primary conrod, crankshaft, flywheel, main motor clutch, etc. is no longer required. This in turn decreases the size of the bodymaker hydraulic power pack which is required in known press mechanisms. Furthermore, an increase in machine speed is possible due to the reduction in mass and subsequent reduction in system inertia which could lead to increased production.

Various knock-on effects are achieved by the use of the hydraulic drive for the bodymaker, such as a reduction in size of power components, flywheel and other drives etc. and thereby reducing load on the bodymaker main bearings and wear.

The rear and forward end faces of the pod may typically be defined by bushings.

The hydraulic fluid may be the machine coolant which is typically already available in the factory supply. The drive uses typically a mixture of 95% water and 5% oil for the hydraulic cylinders. Although this may require of the order of 60 litres/minute, the bodymaker hydraulic power pack can in fact be reduced in size due to the replacement of several components as noted above. The replacement operation is possible simply by means of a retro-fit.

The forward chamber typically comprises a substantially cylindrical portion which tapers radially outwardly at its forward end whereby pressure in the hydraulic chamber is decreased at the forward end. The taper, or chamfer decreases hydraulic pressure at the forward end of the hydraulic chamber since the chamber size is increased at the fluid pressure face but limits fluid requirements in the remainder of the chamber.

The hydraulic drive may ideally include check valves for controlling initial acceleration of the guide pod and/or pressure relief valves for the avoidance of pressure spikes.

Whilst the hydraulic fluid flow may be controlled by a variety of means, ideally a rotary valve is used. The rotary valve may rotate at a speed which is less than or equal to machine speed, according to the desired machine timing.

According to a further aspect of the present invention, there is provided a method of driving a bodymaker, the method comprising: providing a fixed guide rod; connecting the bodymaker to a guide pod which surrounds the guide rod and is movable along the guide rod, the pod having rear and forward end faces which define rear and forward hydraulic chambers respectively, the chambers being separated by a seal; supplying hydraulic fluid to and from the rear hydraulic chamber via a return stroke port; supplying hydraulic fluid to and from the forward hydraulic chamber via a forward stroke port; whereby supplying fluid into the forward chamber drives the pod and bodymaker connected thereto to a forward position and supplying fluid into the rear chamber forces the pod and bodymaker to return to a back position.

Preferably, the end faces comprise bushings for covering and/or opening the ports, and the method further comprises: accelerating movement of the pod and hold down apparatus by uncovering a port and increasing fluid flow to and from the respective chamber; or decelerating the machine stroke by covering a port and reducing fluid flow to and from the respective chamber.

Preferred embodiments of hydraulic drive will now be described, by way of example only, with reference to the drawings, in which:

DESCRIPTION OF THE PREFERRED EMBODIMENTS

Figure 1:
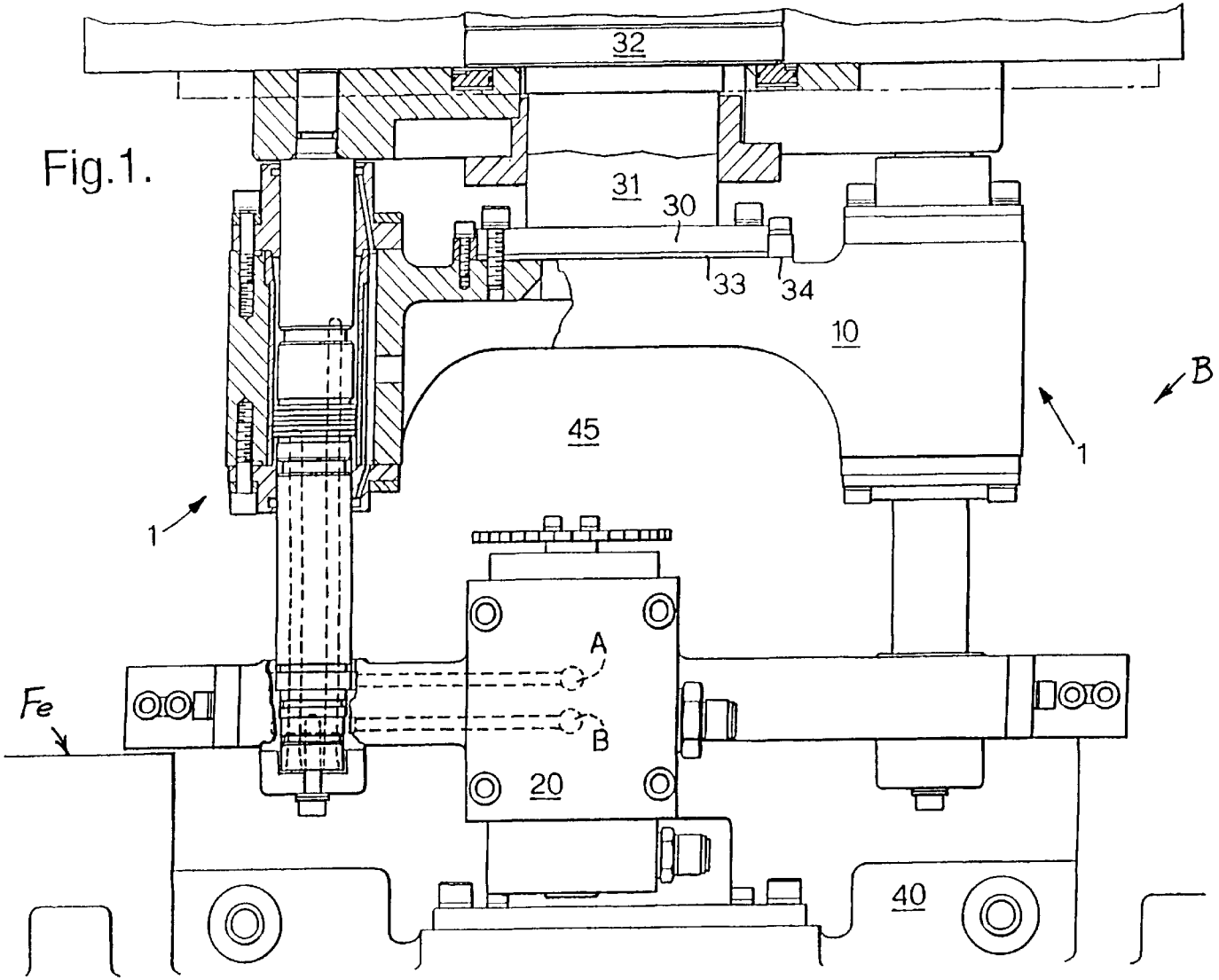
FIG. 1 is a partial side section of a bodymaker showing hydraulic drive and hold down.

FIG. 1 shows a side section of a can bodymaker B having a front end Fe with a hydraulic drive 1 for actuation of hold down assembly 10. A rotary valve 20 controls flow of hydraulic fluid as will be described in more detail below.

Figure 2:
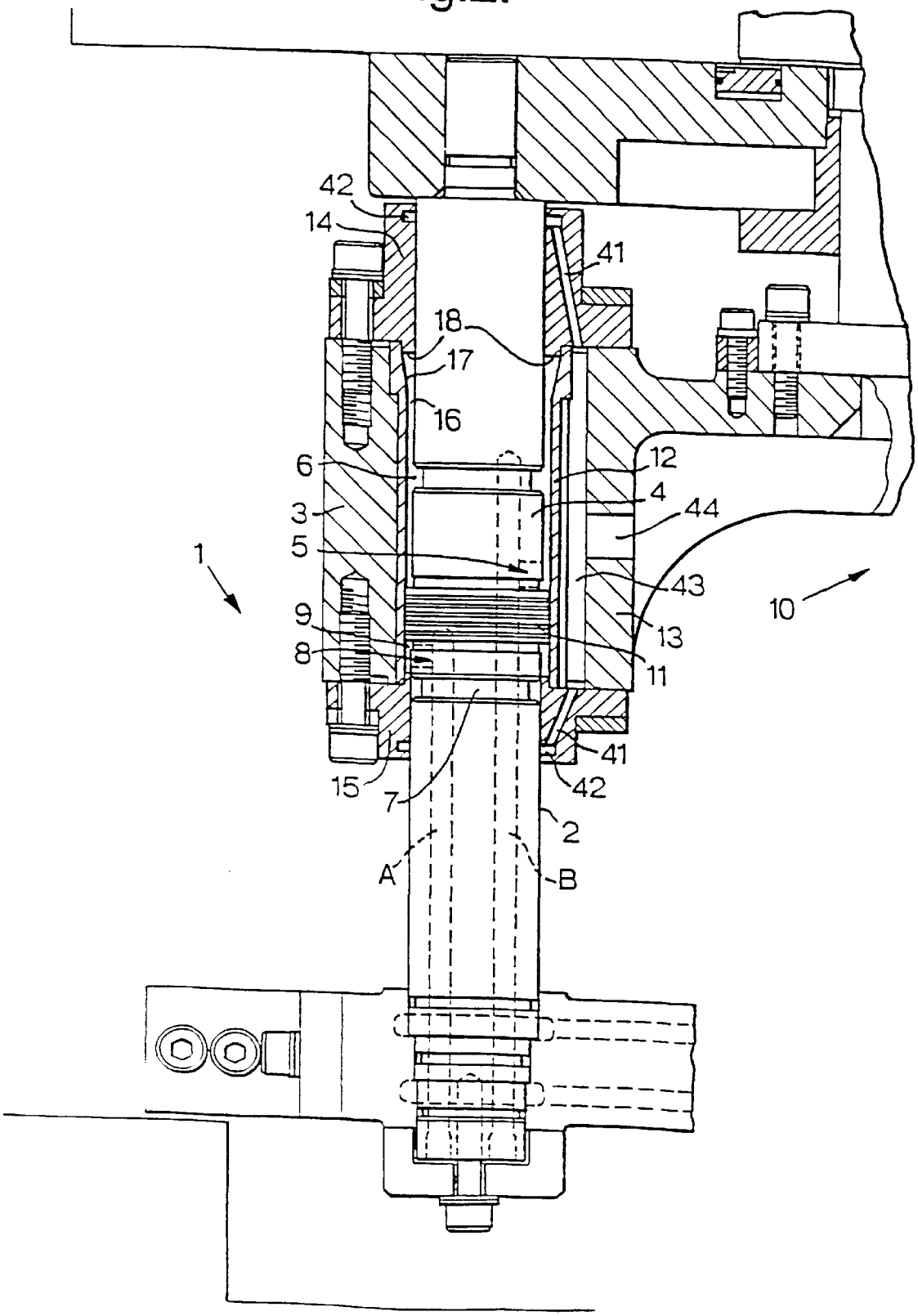
FIG. 2 is an enlarged side section of the drive of FIG. 1.
Figure 3:
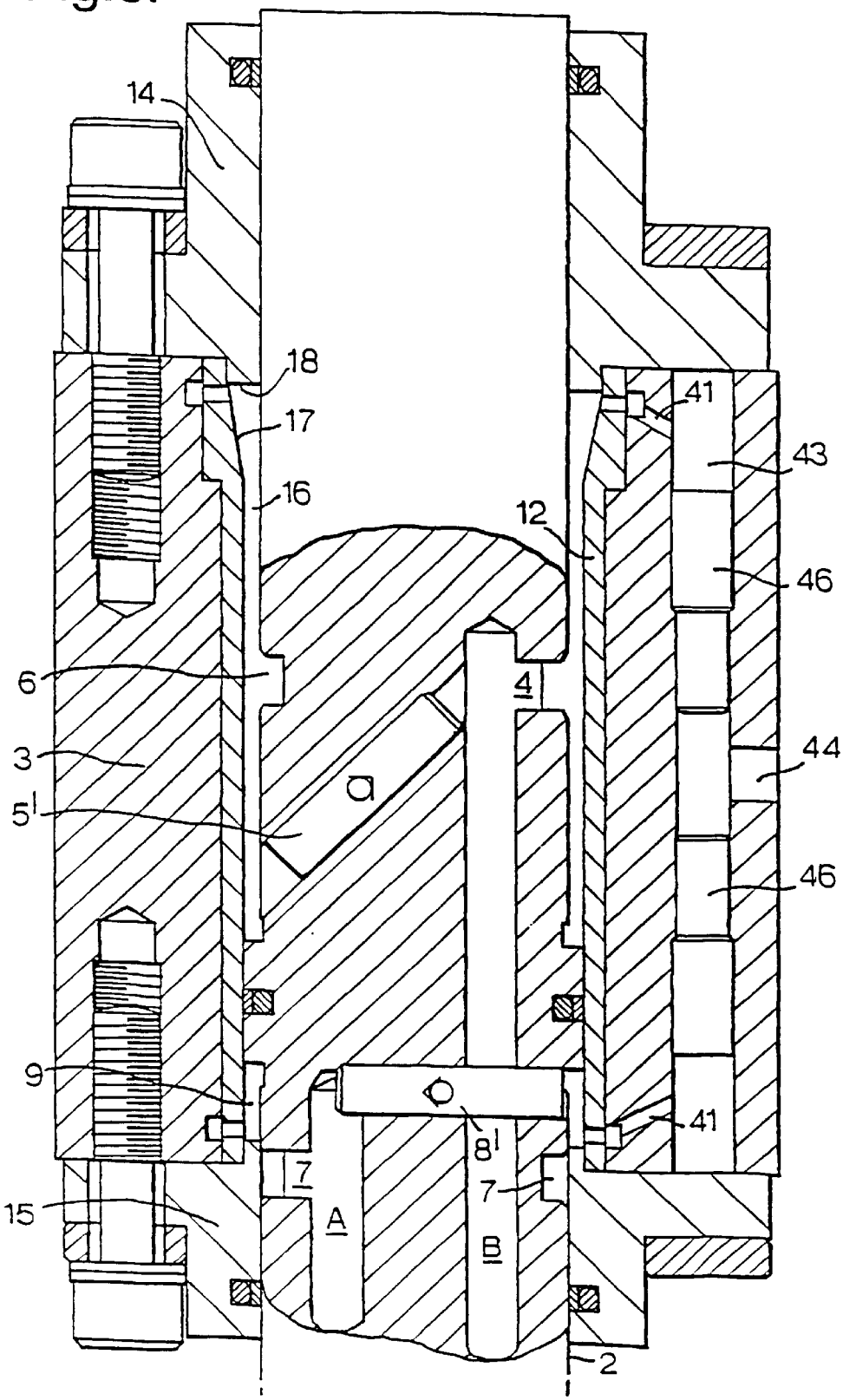
FIG. 3 is an enlarged partial side section of an alternative drive.

As shown in FIGS. 2 and 3, drive 1 consists of a central guide rod 2 and guide pod 3, to which the hold down assembly 10 is connected. The pod 3 has an inner portion 12 which may typically be made of steel so that the guide rod 2 bears against this inner sleeve 12. In order to limit mass and inertia, the pod outer portion 13 is of lighter material, typically aluminum.

Annular space between inner sleeve 12, guide rod 2 and forward and rear bushings 14, 15 is separated into forward and rear chambers 6, 9 respectively by labyrinth seal 11. Guide rod 2 is fixed in position in the bodymaker so that supply of hydraulic fluid to and from forward and rear chambers 6 and 9 forces the pod 3 to move forwards and backwards along the guide rod 2 according to the pressure of hydraulic fluid in the chambers 6 and 9.

Conduits A and B provide channels for passage of hydraulic fluid between rotary valve 20 and the guide rod 2. As shown in FIG. 2, channel A leads via port 7 and/or rear cushion jets 8 to rear chamber 9. Similarly, channel B leads via port 4 and/or forward cushion jets 5 to forward chamber 6. The operation of the ports and cushion jets is described in more detail below. In the embodiment of FIG. 3, check valves 5', 8' are provided in the forward and rear chambers 6, 9 respectively and pressure relief valves 46 are provided in the chamber 43. The operation of these valves is also described in more detail below.

Forward chamber 6 comprises a cylindrical portion 16 which tapers outwardly at its forward end 17 to fluid pressure face 18. The outward taper is defined by the degree of chamfer at the forward end of sleeve 12. Although no equivalent change in size is provided for the return stroke chamber 9, clearly this is possible within the scope of the invention.

Figure 4:
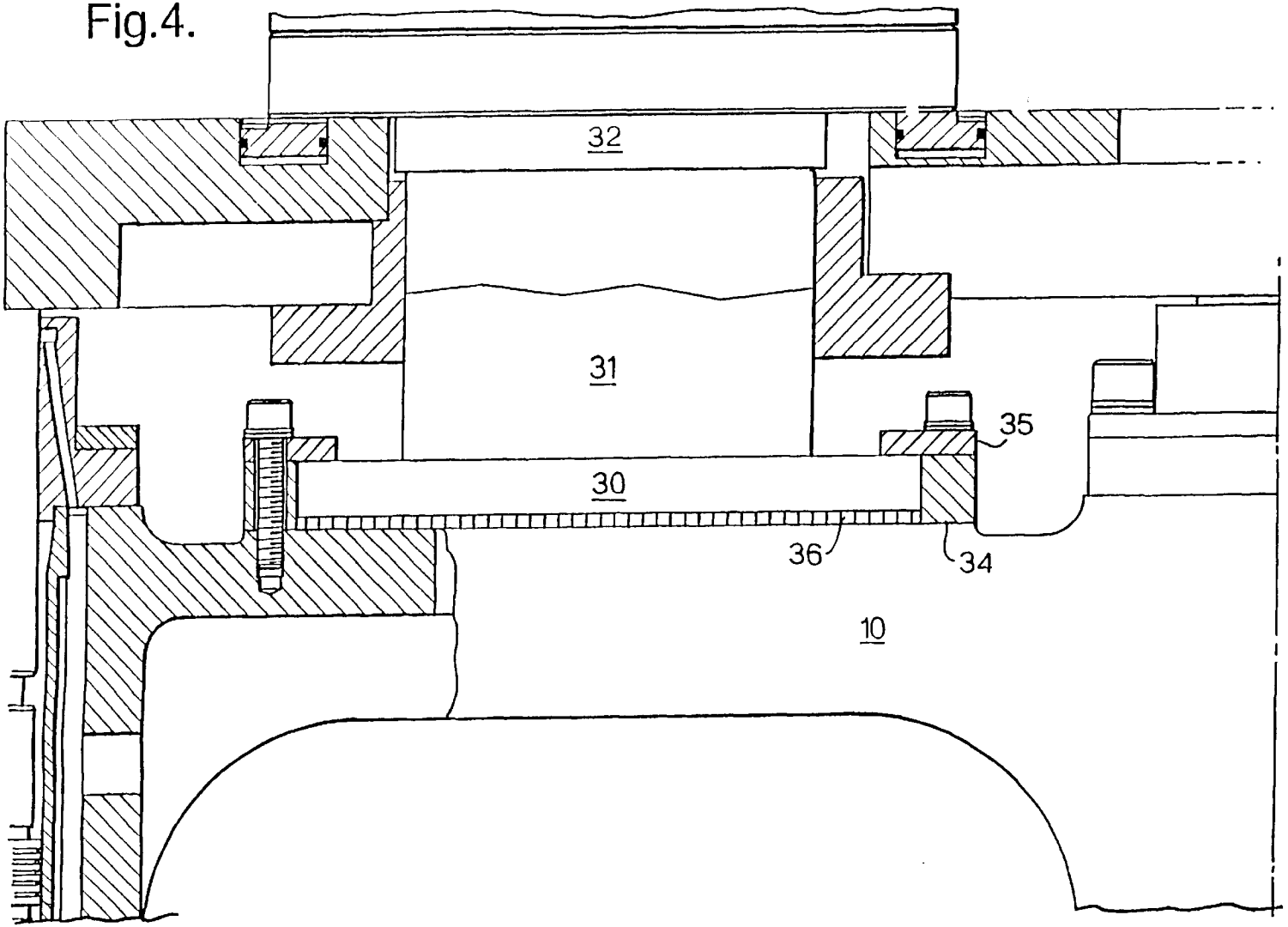
FIG. 4 is an alternative hold down assembly.
Figure 5:
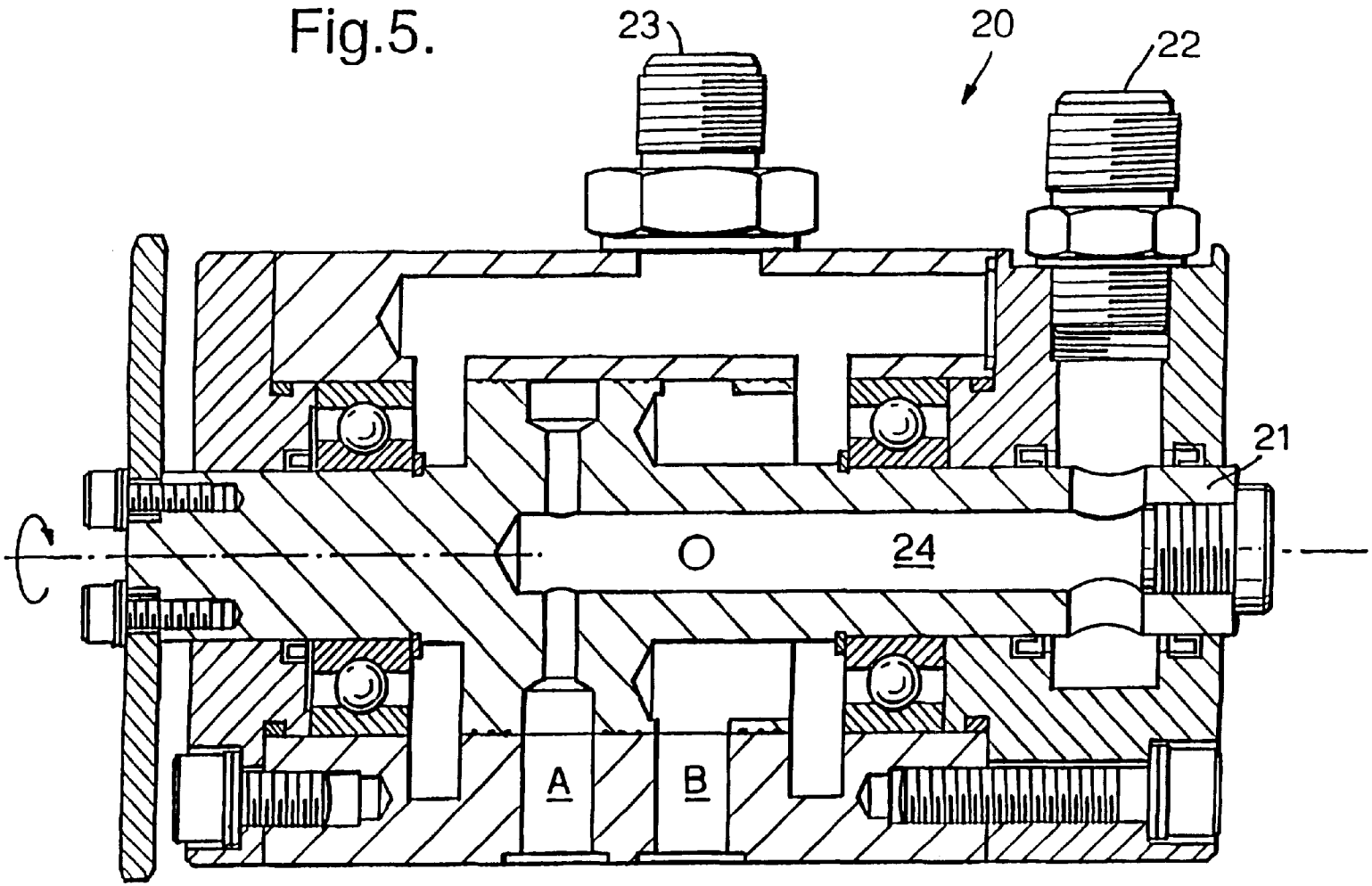
FIG. 5 is a side section of the rotary valve of FIG. 1.

Referring now to FIGS. 1 and 4, hold down assembly 10 comprises a blank holder 30 for holding a cup 31 against redraw die 32. In the embodiment shown in FIG. 1, the hold down apparatus includes a spacer 33 and cantering ring 34. This cantering ring 34 provides for ready access to change the blank holder without the need for lengthy realignment procedures. A retainer 35 and spring 36 may be used instead of the spacer 33, as shown in FIG. 3.

FIG. 4 is a side section of a rotary valve 20 which is used to regulate flow of hydraulic fluid in a preferred embodiment of the invention. As can be seen in FIG. 1, valve 20 supplies fluid to drives 1 on both sides of the hold down apparatus 10. Conduits A and B in each drive unit are connected to drillings A and B in the rotary valve.

Valve 20 is connected to rotor shaft 21 which is driven by the bodymaker main crankshaft and rotates in the direction indicated by the arrow in FIG. 4. Hydraulic fluid from the bodymaker coolant supply enters the rotary valve via inlet 22 and exits via exhaust 23. Inlet 22 and exhaust 23 are shown out of position in FIG. 4 for clarity. A central bore 24 in the shaft 21 connects inlet 22 and exhaust 23 to drillings A or B in the valve according to the desired machine timing. The valve 20 is mounted on a manifold 40 which is bolted onto the bed of the machine.

Operation of the hydraulic drive of the invention is as follows. Pressurized hydraulic fluid from the bodymaker coolant supply is supplied to the bore 24 of central rotor shaft 21 by the action of an accumulator and pump (not shown). As the central shaft 21 rotates, hydraulic fluid passes from the shaft 21 into drilling A when the rotary valve is in the position shown in FIG. 4. Drilling A supplies pressurized fluid along channel A to chamber 9 to drive the return stoke of the hold down.

In the embodiment shown in FIG. 4, the drillings A and B are offset in order to achieve the desired machine timing. For example, the rotary valve may rotate at half machine speed (set by the crankshaft) in order to limit component wear.

Drilling B in rotary valve 20 communicates with the exhaust 23 to exhaust medium in channel B when drilling A is aligned with channel A as shown. Similarly, drilling A communicates with the exhaust 23 to exhaust medium in channel A.

The return stroke of the hold down apparatus occurs when the drilling A of the valve is aligned with channel A as shown in FIG. 4. The return stroke returns the hold down apparatus to the back position.

With reference to FIGS. 1 and 2, passage of fluid from channel A to chamber 9 is blocked by rear bushing 15 but can exit radially outwards into the rear chamber 6 through cushion jets 8. This ensures a relatively gentle start to movement of the pod 3 and hold down assembly away from the cup 31 in redraw die 32 as pressure builds up in rear chamber 9.

As the pressure increases further in the rear chamber, the movement of the pod 3 causes rear bushing 15 gradually to expose return stroke port 7 and allows fluid to pass through the increasingly exposed port 7, thereby providing further acceleration of the return stroke until the port is fully open.

According to the drive timing (set by the valve 20), rotation of the shaft 24 in the valve assembly causes drilling A gradually to close. Meanwhile, movement of the forward bushing 14 causes hydraulic fluid in the forward chamber 6 to exhaust out via channel B. As port 4 is closed by the bushing 14, movement of the pod is slowed until the trailing edge of the port is closed. This deceleration is controlled further by the provision of forward cushion jets 5 which restrict further exhaust and enhance the cushioning effect at the end of the return stroke. The stroke length is determined by the position of the ports 4 and 7 in the guide rod.

As drilling B in the valve assembly opens, pressurized fluid passes from inlet 22 via central bore 24 to conduit B. The forward stroke to drive the hold down assembly forward is then initiated as fluid gradually enters the forward chamber 6 via cushion jets 5. Acceleration of the forward stroke occurs as forward bushing 14 uncovers forward stroke port 4. Meanwhile, fluid from rear chamber 9 is exhausted through channel A to exhaust 23 in the rotary valve. Slowing of the forward stroke is achieved in like manner to that of the return stroke as forward bushing covers the port 4 and fluid enters the forward chamber through a reduced area of port 4 and finally only via cushion jets 8. The cup 31 is then held against the die 32 for redrawing by movement of punch 45 into the cup.

It can be seen from FIG. 2 in particular that the forward and rear bushings 14, 15 provide for acceleration and deceleration of the pod 3 at each end of the forward and return strokes as the bushings gradually close and/or uncover forward and rear ports 4, 7 respectively.

In the embodiment of FIG. 3, check valves 5', 8' are provided which are closed on the exhaust stroke but open for the pressure stroke, thereby allowing fluid to chamber 6 or 9 respectively. This dead ends the fluid which is used to stop the guide pod 3 and applies pressure to the face of associated bushing 14 or 15 until the supply groove is uncovered.

Pressure relief valves 46 prevent the build up of pressure due to fluid compression in chamber 6 or 9 from reaching the point at which pressure spikes occur. Pressure is thus released via channel 41 and pressure relief valves 46.

The hold down apparatus remains in the forward position as the punch 45 enters cup 31 for redrawing. The cycle then repeats.

Any coolant which is forced between the guide rod 2 and the sleeve 16 can be removed by the labyrinth seal 11. Swarf or other debris collects in annuli 42 in the bushings 14 and 15 and exits through passages 41 into chamber 43 in the pod 3 to be passed out via port 44 for processing by the coolant supply.

The invention has been described above by way of example only and changes may be made within the scope of the invention as defined by the claims. For example, in the first embodiment shown in FIG. 2, movement of the pod is controlled not only by the bushings moving over the ports but also by the use of cushion jets 5 and/or 8 between the channels and respective hydraulic chambers. These cushion jets are positioned such that even after the bushing closes the ports, communication is still possible via the cushion jet or jets. In the second embodiment of FIG. 3, a system of check valves is used to prevent "dead ending" of fluid which is used to stop the mechanism, and pressure relief valves for the avoidance of pressure spikes. Clearly any combination of cushion jets and check and pressure relief valves may be used. Alternative features in either of the guide rod or guide pod (or both) which provide an enhanced soft start/stop to the movement of the guide pod are also considered to be within the scope of the invention. The hydraulic drive may be used in a variety of high speed applications where a process coolant and conventional hydraulic oil are used in the same machine but are separated by a bulkhead and seal.

Although a preferred embodiment of the invention has been specifically illustrated and described herein, it is to be understood that minor variations may be made in the apparatus without departing from the spirit and scope of the invention, as defined by the appended claims.

What is claimed is:

1. A hydraulic drive for a can bodymaker, the drive comprising a fixed guide rod;

a guide pod surrounding the guide rod, the pod having rear and forward end faces which together define rear and forward hydraulic chambers respectively, the chambers being separated by a seal;

a first channel (A) for the passage of hydraulic fluid to and from the rear hydraulic chamber via a return stroke port;

a second channel (B) for the passage of hydraulic fluid to and from the forward hydraulic chamber via a forward stroke port;

whereby passage of fluid into the forward chamber drives the pod and bodymaker connected thereto to a forward position and passage of fluid into the rear chamber forces the pod and bodymaker to return to a back position.

2. A drive according to claim 1 in which the rear and forward end faces are defined by rear and forward bushings.

3. A drive according to claim 1 in which the forward chamber comprises a substantially cylindrical portion which tapers outwardly at its forward end whereby pressure in the forward hydraulic chamber is decreased at the forward end.

4. A drive according to claim 1, further comprising a rotary valve for controlling flow of hydraulic fluid.

5. A drive according to claim 4 in which the rotary valve rotates at a speed which is less than or equal to machine speed.

6. A drive according to claim 1 in which the stroke length of the pod and bodymaker is set by the distance between the ports.

7. A drive according to claim 1 in which the hydraulic fluid is obtained from the bodymaker coolant supply.

8. A drive according to claim 1, further comprising a centering ring adjacent the blank holder.

9. A drive according to claim 1, further comprising one of cushion jets and check valves for controlling acceleration of the pod.

10. A drive according to claim 1, further comprising pressure relief valves.

11. A method of driving in a bodymaker, the method comprising:

providing a fixed guide rod;

connecting the bodymaker to a guide pod which surrounds the guide rod and is movable along the guide rod, the pod having rear and forward end faces which define rear and forward hydraulic chambers respectively, the chambers being separated by a seal;

supplying hydraulic fluid to and from the rear hydraulic chamber via a return stroke port;

supplying hydraulic fluid to and from the forward hydraulic chamber via a forward stroke port;

whereby supplying fluid into the forward chamber drives the pod and bodymaker connected thereto to a forward position and supplying fluid into the rear chamber forces the pod and bodymaker to return to a back position.

12. A method according to claim 11 in which the end faces comprise bushings for at least one of covering and opening the ports, the method further comprising performing at least one of:

accelerating movement of the pod and bodymaker by uncovering a port and increasing fluid flow to and from the respective chamber; and decelerating the machine stroke by covering a port and reducing fluid flow to and from the respective chamber.

13. A method according to claim 12, further comprising the step of:

controlling acceleration of the pod by opening check valves and allowing fluid to pass to the bushing until the port is uncovered.

14. A method according to claim 11, further comprising the step of performing one of reducing and eliminating occurrence of pressure spikes by providing pressure relief valves.

* * * * *